United States Patent [19]

Latassa et al.

[11] 4,335,326

[45] Jun. 15, 1982

[54] MERCURY DISPENSER FOR DISCHARGE LAMPS

[75] Inventors: Frank M. Latassa, Magnolia; John G. Ray, Topsfield; Joseph A. Roy, Danvers, all of Mass.

[73] Assignee: GTE Products Corporation, Stamford, Conn.

[21] Appl. No.: 142,904

[22] Filed: Apr. 23, 1980

[51] Int. Cl.[3] ..... H01J 61/28

[52] U.S. Cl. ..... 313/177

[58] Field of Search ..... 313/177, 174

[56] References Cited

U.S. PATENT DOCUMENTS

| | | | |
|---|---|---|---|
| 1,981,669 | 11/1934 | Ronci et al. | 313/177 |
| 2,415,895 | 2/1947 | Lopez | 313/177 |
| 2,991,387 | 7/1961 | McCanley | 313/177 |
| 3,913,999 | 10/1975 | Clarke | 313/177 |
| 4,182,971 | 1/1980 | Cassidy et al. | 313/177 |

*Primary Examiner*—Bruce C. Anderson

*Attorney, Agent, or Firm*—William H. McNeill

[57] ABSTRACT

A glass mercury dispenser for inclusion within an arc discharge lamp is surrounded by a particle shield to catch shards when the capsule is subsequently ruptured.

6 Claims, 2 Drawing Figures

MERCURY DISPENSER FOR DISCHARGE LAMPS

TECHNICAL FIELD

This invention relates to low pressure arc discharge lamps, particularly of the fluorescent type. More especially it relates to a mercury dispenser incorporated within the lamp which will not contaminate the lamp.

BACKGROUND ART

Many methods of inserting mercury into a fluorescent lamp are known, such as use of a dispensing system or incorporation into the lamp of an amalgam which is subsequently caused to release its mercury. These methods, and their disadvantages, are discussed in U.S. Pat. No. 4,182,971.

U.S. Pat. Nos. 2,288,253; 2,415,895; 3,300,037; 3,764,842; 3,794,402; 3,895,709; 3,913,999 and 3,983,439 relate to a third method wherein mercury containing capsules are mounted within a lamp to be subsequently ruptured to release the mercury. These examples require either special heaters proximate the capsule or provide loose particles within the lamp or dislodge the phosphor coating upon rupture or do not lend themselves to high speed machine production.

DISCLOSURE OF INVENTION

It is therefore an object of this invention to obviate the disadvantages of the prior art.

It is another object of the invention to enhance the manufacture of fluorescent lamps.

These objects are accomplished in one aspect of the invention by the provision, within a discharge lamp, of a rupturable mercury containing capsule surrounded by a particle shield. The particle shield is provided with at least one opening sufficient to establish a mercury vapor within the lamp due to the mercury in the capsule.

This provision eliminates the problem of particles within the lamps, does not require the use of an additional heater, does not require the use of an expensive and hard to handle metal dispenser such as disclosed in U.S. Pat. No. 4,056,750, nor the critical cracking requirements of U.S. Pat. No. 4,182,971.

BEST MODE FOR CARRYING OUT THE INVENTION

For a better understanding of the present invention together with other and further objects, advantages and capabilities thereof, reference is made to the following disclosure and appended claims taken in conjunction with the above-described drawings.

Figure 1:
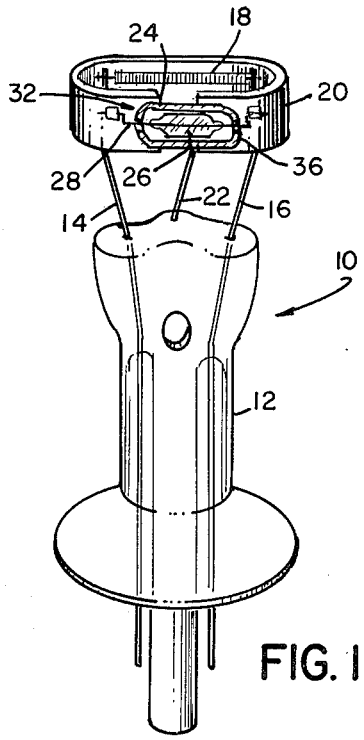
FIG. 1 is a perspective view of a discharge lamp embodying the mercury containing capsule and particle shield of the invention.

Referring now to the drawings with greater particularity there is shown in FIG. 1 a glass mount 10 of an arc discharge lamp comprising a press 12 having lead-in wires 14 and 16 embedded therein. A cathode 18 is mounted between wires 14 and 16 and is surrounded by a disintegration shield 20 which is supported by a wire 22 embedded in press 12. Shield 20 completely encircles cathode 18 except for a small gap 24 between the ends thereof. Bridging gap 24 is a mercury containing glass capsule 26 having an axial wire 28 extending through both ends of capsule 26. Wire 28 is welded to both sides of shield 20.

Figure 2:
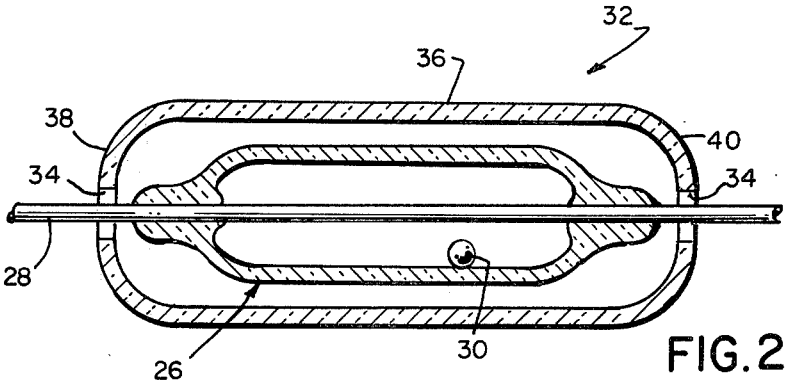
FIG. 2 is an enlarged, sectional view of the capsule and particle shield.

Capsule 26 can be 1 cm long and be made from type 0120 lead glass 90 mm diameter tubing having a wall thickness of 10 mils. Wire 8 can be 20 mil nickel plated Dumet wire. Disposed within capsule 26 is a small ball of mercury 30 (See FIG. 2).

U.S. Pat. No. 4,182,971 details a method of constructing, filling and sealing a suitable glass capsule 26, and the pertinent portions thereof are hereby incorporated by reference as one example of such a capsule.

In the instant case capsule 26 is surrounded by a particle shield 32 having at least one opening 34 therein for the release of the mercury.

The particle shield 32 comprises a generally cylindrical body 36 having an inside diameter slightly larger than the outside diameter of capsule 26. In the embodiment shown particle shield 32 is made of glass; however, metal or other suitable materials can be employed.

The ends 38 and 40 of body 36 are closed down nearly to the wire 28 after body 36 has been sleeved over capsule 26. This insures the permenant placement of body 36. Slight openings 34 are left for the escape of the mercury after capsule 26 is ruptured, this rupturing taking place after mount 10 with capsule 26 and particle shield 32 are sealed into a finished lamp.

The above cited patent, U.S. Pat. No. 4,182,971 discloses a method of rupturing the capsule 26 by causing it to crack after a controlled application on RF heating. While this procedure works well, any excess heat developed by the capsule opening process may shatter capsule 26 instead of just causing it to crack.

Thanks to the present invention, if this shattering should occur, particle shield 32 retains the glass shards and prevents them from injuring the phosphor coating or otherwise contaminating the lamp.

The openings 34 thus should be large enough to permit the escape of the mercury but small enough to prevent egress of glass shards large enough to cause damage to the lamp.

It is to be noted that there are other advantages obtained from employment of particle shield 32. Thus, the particle shield 32 protects the hermetic seals of capsule 26 during mounting to the disintegration shield 20 by supporting the axial wire 28 since wire 28 can rest against the edge of particle shield 32 as the wire 28 is bent slightly for mounting. This is a unique feature since it is important that capsule 26 remain hermetically sealed during mounting and lamps processing.

While particle shield 32 is conveniently formed from pre-existing tubing, it is also comtemplated that it can be formed from sheet material which is subsequently wrapped around capsule 26 to form a tube or the like.

While there have been shown and described what are at present considered to be the preferred embodiments of the invention, it will be apparent to those skilled in the art that various changes and modifications can be made herein without departing from the scope of the invention as defined by the appended claims.

We claim:

1. In an arc discharge lamp having a glass mount at one end with a cathode supported on the mount, a disintegration shield encircling the cathode except for a gap between the ends of the shield, a mercury containing glass capsule disposed at about the gap region of said disintegration shield, said mercury containing capsule having an axially disposed wire sealed therein, said wire having protruding ends, each end of said wire being connected to a respective side of said disintegration shield, said glass capsule being rupturable and forming particles upon receipt of energy from a source external of said lamp to release said mercury and establish a mercury vapor pressure in said lamp, the improvement comprising: a particle shield for containing said particles from said capsule surrounding said glass capsule and containing at least one opening for the release of said mercury, said opening having a diameter substantially smaller than the diameter of said mercury containing capsule whereby said particles are retained within said particle shield.

2. The lamp of claim 1 wherein said particle shield is glass.

3. The lamp of claim 2 wherein said at least one opening is substantially concentric with said wire.

4. The lamp of claim 3 wherein said particle shield has two openings.

5. The lamp of claim 4 wherein said openings are disposed at opposite ends of said particle shield.

6. The lamp of claim 5 wherein each of said openings is substantially concentric with said wire.

* * * * *